US006469684B1

(12) United States Patent
Cole

(10) Patent No.: US 6,469,684 B1
(45) Date of Patent: Oct. 22, 2002

(54) COLE SEQUENCE INVERSION CIRCUITRY FOR ACTIVE MATRIX DEVICE

(75) Inventor: James R Cole, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/394,976

(22) Filed: Sep. 13, 1999

(51) Int. Cl.[7] ..... G09G 3/36
(52) U.S. Cl. ..... 345/58; 345/96
(58) Field of Search ..... 345/209, 54, 79; 348/910, 609, 615, 790, 792, 800

(56) References Cited

U.S. PATENT DOCUMENTS

| | | | | | |
|---|---|---|---|---|---|
| 5,359,156 | A | * | 10/1994 | Chan et al. | 178/19 |
| 5,648,793 | A | * | 7/1997 | Chen | 345/96 |
| 5,886,659 | A | * | 3/1999 | Pain et al. | 341/155 |
| 6,023,257 | A | * | 2/2000 | Koyama | 345/58 |
| 6,084,562 | A | * | 7/2000 | Onda | 345/94 |
| 6,125,147 | A | * | 9/2000 | Florencio et al. | 375/240 |
| 6,140,990 | A | * | 10/2000 | Schlig | 345/92 |
| 6,219,019 | B1 | * | 4/2001 | Hasegawa et al. | 345/96 |
| 6,222,596 | B1 | * | 4/2001 | Veerasamy | 349/50 |
| 6,243,062 | B1 | * | 6/2001 | den Boer et al. | 345/91 |

FOREIGN PATENT DOCUMENTS

| | | | |
|---|---|---|---|
| EP | 0190694 B1 | 6/1991 | H03M/3/02 |

OTHER PUBLICATIONS

Sharp LCD Application Note, Liquid Crystal Displays, "Image Quality: Measurements And Definition", by alan Dragon, 1993, pp. 1–8.

Vesa Standards, Flat Panel Display Measurement Standard Version 1.0, May 15, 1998, 301–2g, 301–2h, 301–2i, 301–2j, 301–3f, 301–3g, 301–3h, 305–2, 305–4, 305–5, A300–Glossary, pp 1–265 (and Title Pages).

Spread Spectrum Systems—Second Edition, by Robert C. Dixon, A Wiley–Interscience Publication—John Wiley & Sons, 1984, pp: 60–61, 79–83 and 87–89.

* cited by examiner

*Primary Examiner*—Vijay Shankar
*Assistant Examiner*—Nitin Patel
(74) *Attorney, Agent, or Firm*—Timothy F. Myers

(57) ABSTRACT

An active matrix device has a plurality of drive signals, a plurality of select signals and an array of sub-pixels. Each of the sub-pixels has an electronic element connected to one of the drive signals and one of the select signals to display. The active matrix device also includes inversion circuitry coupled to the drive signals that has at least one Cole sequence generator. A Cole sequence generator provides a random, semi-random or pseudo-random sequence pattern. The inversion circuitry is capable of reducing the direct current bias voltage applied by the electronic element to the sub-pixel. The inversion circuitry is further capable of reducing flicker of the active matrix device.

29 Claims, 11 Drawing Sheets

Frame 1

| | 1 | 2 | 3 | 4 |
|---|---|---|---|---|
| 1 | - | + | + | - |
| 2 | + | - | + | + |
| 3 | + | - | - | - |
| 4 | + | - | - | + |

Frame 2

| | 1 | 2 | 3 | 4 |
|---|---|---|---|---|
| 1 | - | + | - | - |
| 2 | - | + | + | + |
| 3 | - | + | + | - |
| 4 | - | + | + | - |

Frame 3

| | 1 | 2 | 3 | 4 |
|---|---|---|---|---|
| 1 | - | + | + | - |
| 2 | + | + | - | + |
| 3 | - | + | + | - |
| 4 | + | - | + | + |

Frame 4

| | 1 | 2 | 3 | 4 |
|---|---|---|---|---|
| 1 | - | + | - | - |
| 2 | + | - | + | + |
| 3 | + | - | - | + |
| 4 | + | - | - | + |

Frame 1

| | 1 | 2 | 3 | 4 |
|---|---|---|---|---|
| 1 | + | + | + | + |
| 2 | + | + | + | + |
| 3 | + | + | + | + |
| 4 | + | + | + | + |

Frame 2

| | 1 | 2 | 3 | 4 |
|---|---|---|---|---|
| 1 | - | - | - | - |
| 2 | - | - | - | - |
| 3 | - | - | - | - |
| 4 | - | - | - | - |

Fig. 2A

Frame 1

| | 1 | 2 | 3 | 4 |
|---|---|---|---|---|
| 1 | + | + | + | + |
| 2 | - | - | - | - |
| 3 | + | + | + | + |
| 4 | - | - | - | - |

Frame 2

| | 1 | 2 | 3 | 4 |
|---|---|---|---|---|
| 1 | - | - | - | - |
| 2 | + | + | + | + |
| 3 | - | - | - | - |
| 4 | + | + | + | + |

Fig. 2B

Frame 1

| | 1 | 2 | 3 | 4 |
|---|---|---|---|---|
| 1 | + | - | + | - |
| 2 | + | - | + | - |
| 3 | + | - | + | - |
| 4 | + | - | + | - |

Frame 2

| | 1 | 2 | 3 | 4 |
|---|---|---|---|---|
| 1 | - | + | - | + |
| 2 | - | + | - | + |
| 3 | - | + | - | + |
| 4 | - | + | - | + |

Fig. 2C

Frame 1

| | 1 | 2 | 3 | 4 |
|---|---|---|---|---|
| 1 | + | - | + | - |
| 2 | - | + | - | + |
| 3 | + | - | + | - |
| 4 | - | + | - | + |

Frame 2

| | 1 | 2 | 3 | 4 |
|---|---|---|---|---|
| 1 | - | + | - | + |
| 2 | + | - | + | - |
| 3 | - | + | - | + |
| 4 | + | - | + | - |

Fig. 2D

Frame 1

| | 1 | 2 | 3 | 4 |
|---|---|---|---|---|
| 1 | - | + | + | - |
| 2 | + | - | + | + |
| 3 | + | - | - | - |
| 4 | + | - | - | + |

Frame 2

| | 1 | 2 | 3 | 4 |
|---|---|---|---|---|
| 1 | - | + | - | - |
| 2 | - | + | + | + |
| 3 | - | + | + | - |
| 4 | - | + | + | - |

Frame 3

| | 1 | 2 | 3 | 4 |
|---|---|---|---|---|
| 1 | - | + | + | - |
| 2 | + | + | - | + |
| 3 | - | + | + | - |
| 4 | + | - | + | + |

Frame 4

| | 1 | 2 | 3 | 4 |
|---|---|---|---|---|
| 1 | - | + | - | - |
| 2 | + | - | + | + |
| 3 | + | - | - | + |
| 4 | + | - | - | + |

Fig. 3

COLE SEQUENCE INVERSION CIRCUITRY FOR ACTIVE MATRIX DEVICE

FIELD OF THE INVENTION

The invention relates to active matrix devices, such as an active matrix LCD display. In particular the invention relates to driving the bias inversion circuitry of active matrix devices.

BACKGROUND OF THE INVENTION

Electronic devices, such as notebook computers and personal data assistants, to name a couple, have liquid crystal displays (LCDs) for presenting information to users of the electronic devices. In comparison with conventional video graphic cathode-ray tube (CRT) terminals used with desktop computers and televisions, LCDs consume less power, are thinner, lighter in weight, and typically are more expensive. While LCDs have some visual display quality benefits over CRTs, such as exceptional geometric linearity and sharpness, LCDs have typically lagged CRTs in other visual display quality areas such as viewing angle, brightness, and display speed.

An LCD is typically formed of an array or matrix of individual pixels that determine the LCD resolution. The visual display quality properties are generally determined by how a pixel is fabricated and driven on an LCD. A pixel is the smallest element of a display surface that can reproduce the full range of luminance and colors of the LCD. For color displays, each pixel can further be broken up into three sub-pixels that represent the red, green, and blue colors used generate the overall perceived color of the pixel. Thus, a sub-pixel is the smallest driven element in an AM-LCD. For a monochrome display, a single sub-pixel may represent an entire pixel. When a pixel is described as being white, it means that each sub-pixel element for the pixel is being driven to its maximum luminance. When a pixel is described as black, it means each sub-pixel is set at it minimum luminance.

Manufacturers of LCDs have developed new LCD technology known as active-matrix (AM) LCD. The active-matrix LCD incorporates additional components on the display to drive each sub-pixel such that the viewing angle, brightness (perceived luminance), and display speed is improved to levels which allow AM-LCDs to compete with CRTs. This competition exists not only for portable electronic devices but also as display monitors for desktop computers, televisions, and projectors, to name a few.

However, one visual display quality that persists for AM-LCDs is display "flicker". Flicker is an intermittent change in light intensity perceived by an eye. Flicker is caused by the manner in which the sub-pixels on the display are driven by circuitry that is used to remove direct-current bias voltage to the sub-pixel. If the direct-current bias voltage is not removed, permanent physical display artifacts may form on the display surface irreparably damaging the display. Manufacturers of AM-LCDs have tried several different approaches to reducing display flicker. Unfortunately, these different approaches still produce flicker when commonly used patterns are displayed on the AM-LCD screen. Since the flicker occurs when certain common patterns are displayed, the user is often annoyed and will at times call the manufacturer of the electronic device to inquire if their device is defective. Since the flicker goes away when the pattern on the AM-LCD screen changes, sometimes the user believes that their device is malfunctioning intermittently and may try to return it. Manufacturers of electronic devices are unable to help the user of the device except to try to explain the flicker characteristic. This type of response by a manufacturer may lead to frustration by the user since the user's problem is not being corrected but just explained away. Accordingly, as the cost of AM-LCDs approach that of CRTs and become more popular, user dissatisfaction, the number of service calls and product returns will increase if a solution to the display flicker quality issue is not found.

Another problem with flicker, potentially serious, is that display flicker can cause discomfort in varying degrees depending on the individual, and can precipitate epileptic seizures in susceptible individuals (see Flat Panel Display Measurements Standard Version 1.0, Video Electronics Standards Association, Ver. 1.0, Jun. 9, 1998, p. 92). The problem tends to be worse for frequencies near 10 Hz. Thus if any display has a substantial flicker component near 10 Hz, this is a cause for concern. Therefore, there is a need for AM-LCDs to reduce direct-current bias voltage in a manner that display flicker is reduced or substantially eliminated, in particular in the frequencies near 10 Hz.

SUMMARY

An active matrix device has a plurality of drive signals, a plurality of select signals and an array of sub-pixels. Each of the sub-pixels has an electronic element connected to one of the drive signals and one of the select signals to display. The active matrix device also includes inversion circuitry coupled to the drive signals that has at least one Cole sequence generator. A Cole sequence generator provides a random, semi-random or pseudo-random sequence pattern. The inversion circuitry is capable of reducing the direct current bias voltage applied by the electronic element to the sub-pixel. The inversion circuitry is further capable of reducing flicker of the active matrix device.

BRIEF DESCRIPTION OF THE DRAWINGS

FIG. 2A is an illustration of a conventional frame based inversion method that repeats every two frames.

FIG. 2B is an illustration of a conventional row based inversion method that repeats every two frames.

FIG. 2C is an illustration of a conventional column based inversion method that repeats every two frames.

FIG. 2D is an illustration of a conventional checkerboard pattern based inversion method that repeats every two frames.

FIG. 3 is an exemplary illustration of an inversion method based on an embodiment of the invention that presents different inversion patterns each frame.

DETAILED DESCRIPTION OF THE PREFERRED AND ALTERNATE EMBODIMENTS

Figure 1B:
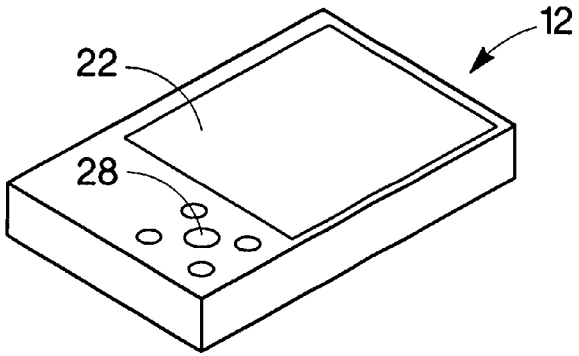
FIG. 1B is an illustration of a personal data assistant having an LCD active matrix display that incorporates at least one aspect of the invention.
Figure 1A:
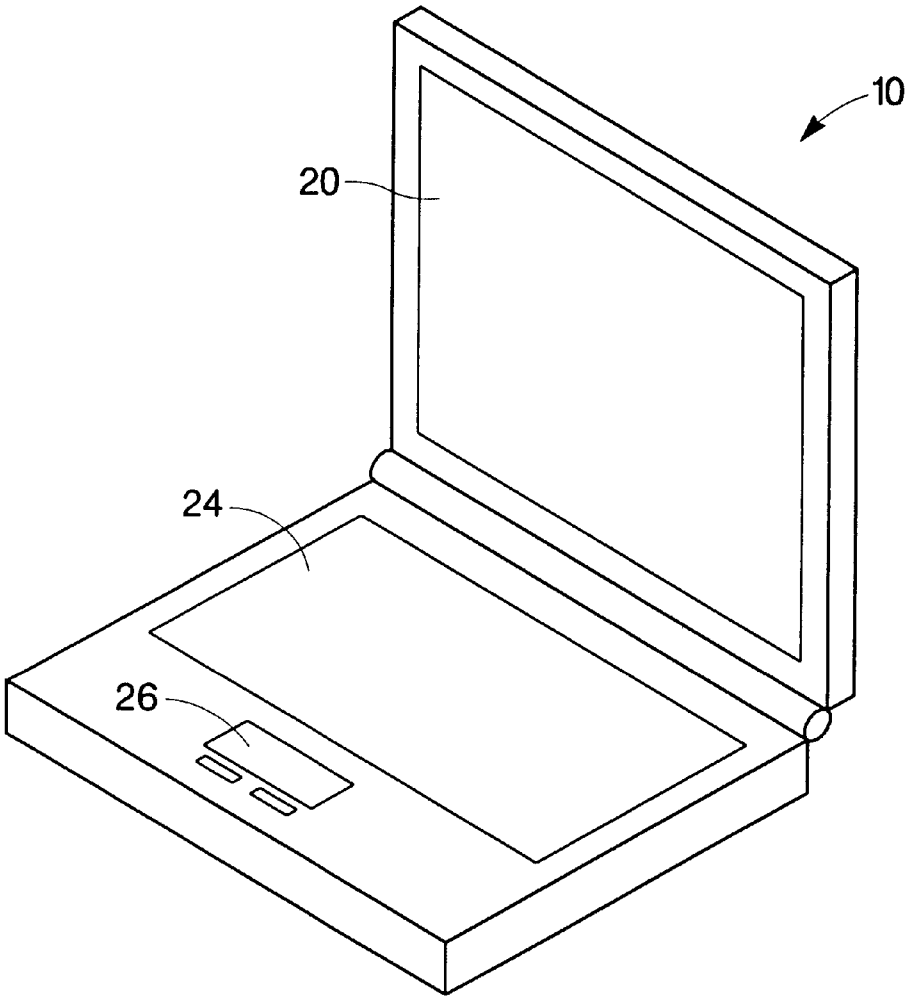
FIG. 1A is an illustration of a notebook computer having an LCD active matrix display that incorporates at least one aspect of the invention.

FIGS. 1A and 1B are illustrations of electronic devices, such as a notebook computer (FIG. 1A) and a personal data assistant (FIG. 1B), which have an active matrix liquid crystal display (AM-LCD) used as the primary display device.

In FIG. 1A, the notebook computer 10 has an AM-LCD 20 as a display device and a keyboard 24 and touchpad 26 as input devices. In FIG. 2B, the personal data assistant 12 has a small AM-LCD as a display device and a keypad 28 as an input device. Those skilled in the art will appreciate that several different electronic devices such as TVs, display monitors, video games, and video projectors, to name a few, are capable of using AM-LCDs and would still meet the spirit and scope of the invention. Further, AM-LCDs may be used in applications other than as displays, such as optical multipliers to reduce injected noise, and still be able to benefit from the incorporation of the invention into an AM-LCD device. AM-LCDs present the user with successive frames of image data, analogous to successive frames of images seen on a roll of movie film. A frame generally consists of one full scan of an image on the display screen by sequentially activating successive rows of sub-pixels. With conventional AM-LCDs, a user often notices that a display has some "flicker". Flicker is the perceptible rapid temporal luminance variation of a nominally constant-luminance (static) image pattern displayed on an AM-LCD caused by the synchronization or alignment of the pattern displayed on the AM-LCD with a predetermined pattern used by the display control circuitry to remove direct-current bias voltage from the sub-pixels within the AM-LCD. The removal of direct-current bias voltage uses a technique called "inversion". Inversion is done to prevent unwanted display artifacts from forming within sub-pixel cells. Inversion circuitry drives the display sub-pixels with voltages of alternating polarity in order to remove the direct-current bias voltage. However, due to various display properties, such as imperfections in matching polarities when inversion occurs and lateral coupling within the panel to name a couple, the alternate polarities do not perfectly cancel, causing a small amount of frame to frame fluctuation in luminance. When the pattern used to invert the display closely matches the image data presented on the display, the flicker becomes noticeable and objectionable by the viewer. This is due to a high cross-correlation between the image data and the inversion pattern used. The eye detects this cross-correlation because the image data for each respective sub-pixel of the image is essentially multiplied by a respective bit in the inversion pattern in the inversion circuitry and the eye integrates the resultant aggregate luminance from a group of sub-pixels within the eye's viewing cone. In some situations, such as when only black levels are shown on the display (very low or no luminance of pixels), flicker is generally not noticeable by the viewer of the display. Therefore, noticeable flicker is dependent on the image pattern presented on the display and the inversion pattern used to invert the display based upon the cross-correlation of the two patterns. Depending on the spatial distribution of the matches and non-matches in the cross-correlation of the image and inversion patterns within the eye's viewing cone, a power spectral density containing the frequency components of the flicker can be predicted. Flicker can also be analytically measured (see Flat Panel Display Measurements Standard Version 1.0, Video Electronics Standards Association, Ver. 1.0, Jun. 9, 1998, §§ 301–3f, 305–4,5) but unless the measured flicker level exceeds a minimum human perception threshold, the AM-LCD is not properly said to be flickering as the flicker is unnoticeable. There is, however, a wide variation in observer sensitivity to flicker. Flicker may be noticeable to one person but imperceptible to another. Generally, for most humans, the eye is sensitive to flicker having a frequency component of 60 Hz or less. The eye is half as likely to be affected by flicker having a 40 Hz component than a component of 20 Hz or less. At 50 Hz the eye is one-forth as likely to be affected by flicker than 20 Hz or less. However, the eye is 100 times less susceptible to flicker having 60 Hz or greater components than if the flicker has frequency components of 20 Hz or less. Thus, if the frequency components of flicker can be restricted to 60 Hz or more, flicker is substantially reduced or non-perceptible. Before describing how the present invention reduces flicker, it is helpful to see how flicker reduction is conventionally achieved.

FIG. 2A is an illustration showing a conventional pattern for inverting an AM-LCD display over successive frames. In frame 1, all pixels are driven to positive voltage levels. In frame 2, all of the cells are driven to negative voltage levels. This technique is called "frame-inversion". This pattern inversion method produces considerable flicker because the entire display is changing polarity at once resulting in a large cross-correlation between the image pattern and the inversion pattern. However, this frame-inversion technique has the advantage of being uncomplicated to implement. Because the flicker caused by frame-inversion is very objectionable by users of AM-LCDs, other inversion methods have been developed to improve the display quality by spreading the alternating polarities across the display so that they are presented on a row-by-row, column-by-column, or sub-pixel-by-sub-pixel basis.

FIG. 2B is an illustration of the "row-by-row inversion" pattern performed over two frames. In frame 1, odd rows are driven to positive levels and even rows are driven to negative levels. In frame 2, the odd rows are driven to negative levels and the even rows are driven to positive levels. Row-by-row inversion is used in conventional SVGA displays and first generation XGA displays. Although each row produces flicker, the user generally does not perceive flicker overall because the eye averages light over large areas. It is possible, however, for a particular display pattern to synchronize with the inversion pattern thus causing a high cross-correlation between image and inversion patterns and still allow the user to perceive flicker. For example, if all odd rows are black and all even rows are gray, then flicker is especially noticeable since gray is often the most sensitive color for AM-LCD flicker. This gray level flicker is due to the method in which some gray levels are achieved using frame level modulation of the image signal. This gray level flicker is also due to the liquid crystal material being most sensitive to bias errors when trying to generate a gray image. Although this flicker effect is most prevalent in test patterns displaying alternating rows, the user is able to produce this flicker effect (a sufficient cross-correlation of image and inversion patterns) in a personal computer by having no background selected in the Windows™ operating system and then selecting the "key" pattern for the display wallpaper. Because this flicker is related to the image pattern on the display screen, the user is often surprised and confused when it suddenly occurs and then disappears. As the user is unaware that the flicker is related to the display pattern, the user may believe that the display device is misoperating and might request service.

FIG. 2C is an illustration of the "column-by-column inversion" pattern performed over two frames. In frame 1, odd columns are driven to positive levels and even columns are driven to negative levels. In frame 2, odd columns are driven to negative levels and even columns are driven to positive levels. This technique has similar problems as described for the row-by-row approach in FIG. 2B.

FIG. 2D is an illustration of the "sub-pixel-by-sub-pixel inversion" pattern performed over two frames. In this technique, a checkerboard pattern is driven positive in the first frame along with negatively driven sub-pixels adjacent to the positively driven sub-pixels. Again, although each sub-pixel produces flicker at the pixel level, the eye averages light intensity over a large area to cancel the flicker effect over an entire image frame (minimal cross-correlation of image and inversion patterns). However, if the image pattern has alternating sub-pixels set to black and the remaining sub-pixels set to gray, the entire screen appears to the user to flicker. Unfortunately, this image pattern happens when a user shuts down a personal computer with the Windows™ operating system. When Windows™ shuts down it darkens the screen. The screen darkening effect is achieved by setting some sub-pixels to black using a checkerboard pattern. Thus sufficient cross-correlation of the image and inversion patterns occurs to produce perceptible flicker.

Because the foregoing conventional approaches are able to create flicker when the image patterns synchronize or align with the inversion pattern (causing substantial cross-correlation), a new flicker reduction approach is taken by the invention. The invention prevents synchronization of the image and inversion patterns by driving the inversion circuitry with what is defined as a "Cole sequence" pattern using a "Cole sequence generator." A "Cole sequence generator," as defined herein, creates a random, semi-random, or pseudo-random binary pattern that is used to create a positive/negative inversion pattern that is substantially uncorrelated with static image patterns over successive frames. A Cole sequence generator preferably (but optionally) produces a binary pattern that is substantially statistically independent from a static image pattern presented over successive frames. By being substantially statistically independent, the inversion pattern is uncorrelated with a presented static image pattern over the successive frames. Further, the Cole sequence generator preferably (but optionally) limits the maximum run lengths of positive/negative inversion patterns to ensure that the power spectral frequencies of any flicker generated are substantial reduced below 60 Hz. With the invention, it is substantially improbable to have any single display pattern (static or dynamically changing) align or synchronize with an inversion pattern that is constantly changing due to the characteristics of the Cole sequence generator. Each sub-pixel of the AM-LCD still has substantially a zero net direct-current (DC) bias voltage, because the Cole sequences chosen also generate substantially an equal number of positive and negative drive levels over successive frames. A zero net DC bias voltage preferably occurs because the distributions of positive and negative levels are chosen for all practical purposes to be statistically independent and thus random like. Although each sub-pixel may produce a small amount of temporal luminance, the eye's ability to average light intensity (perceived luminance) over a large area does not allow the user to perceive the display as a whole to flicker as the cross-correlation of the image and inversion patterns are minimal due to the statistical independence of the image and inversion patterns over successive frames.

FIG. 3 is an illustration of an exemplary inversion pattern produced by one embodiment of the invention that illustrates a Cole sequence inversion pattern using a Cole sequence generator over several frames. In frame 1, a first Cole sequence pattern of positive and negative polarities is applied to the display. In frame 2, a second Cole sequence pattern is applied to the display and similarly for frames 3, 4 and so on. Over time, each sub-pixel is presented with substantially an equal number of positive and negative drive levels to prevent the generation of undesirable display artifacts that might occur under a DC bias. When choosing a Cole sequence generator pattern, it is preferable to prevent long strings of positive or negative biases to reduce the likelihood of display artifacts from forming. Further, noticeable flicker may occur if groups of pixels change near each other in time or the Cole sequence inversion patterns produce synchronization or alignment with the image pattern. Therefore, it is preferable to have a rapidly changing inversion pattern that does not repeat often at the sub-pixel level to prevent flicker frequency components below 60 Hz.

One type of Cole sequence generation is the production of pseudo-random "maximal code" sequences using binary linear feedback shift registers of n stages. Maximal codes have the desired property that the number of 'ones' in a maximal code sequence equals the number of 'zero' plus one additional 'one'. Thus when a 'one' represents a positive polarity and a 'zero' a negative polarity for the inversion pattern, the amount of residual offset of DC bias voltage over a code length $r=2^n-1$ is proportional to the inverse of the code length (e.g. DC bias voltage $\sim 1/(2^n-1)$). For long code sequences, this residual offset may be minimal and ignored. However, if desired, this small amount of residual offset is cancelled in one embodiment of the invention by alternately inverting the code sequence after each complete code length r cycle (see FIG. 7B).

Another feature of maximal code sequences is that the statistical distribution of runs of 'ones' and 'zero' are well defined and remain constant. A run is defined as a series of 'ones' or 'zero' grouped consecutively together. Relative positions of runs of 'ones' and 'zero' vary from code sequence to code sequence but the number of each run length does not. In fact, every possible state except the all 'zero' state, of a given n-stage generator exists at some time during the generation of a complete code cycle. Each state exists for one and only one clock interval, except for the all-zeros state. The distribution of run lengths has been shown to consist of $2^{n-(p+2)}$ runs for length p for both 'ones' and 'zero' in every maximal code sequence with only a few exceptions (See R. C. Dixon, Spread-Spectrum Systems, John Wiley and Sons, New York, 1984, pp. 60–61). The exceptions are that there is only one run containing n 'ones' and one run containing n−1 'zero' and there are no runs of 'zero' of length n or runs of 'ones' of length n−1. One concern in choosing the length of a code length r is that if r is chosen very long to increase randomness (because maximal codes repeat each r cycle) or to reduce residual direct-current bias voltage, the inevitability of a long length run of 'ones' or 'zero' may produce flicker. This is especially true if the code length r is greater than the number of sub-pixels on the AM-LCD. Thus the desired code length r is preferably chosen based on the display resolution of the desired AM-LCD and the AM-LCD liquid crystal chemical properties such that display artifacts are not formed and that the component frequencies of flicker are greater than 60 Hz.

Another property of maximal codes is that a modulo-2 addition (or multiplication) of one maximal code with a phase-shifted version of itself results in another replica of the maximal code with a phase shift different from either of the originals. This property is exploited in one embodiment of the invention discussed below.

Another important modulo-2 addition property is that the addition of two different maximal code sequences, each of length r, produces a composite sequence also of length r although the composite sequence is not itself maximal. The composite sequence itself, however, is different for each combination of delays between the two maximal code sequences. Thus, just a pair of sequence generators of sn stages generating $r=2^n-1$ length codes can generate r non-maximal linear codes, each with a length of r. The composite sequences are known as "Gold-code" sequences. Since a large number of codes can be produced with just two sequence generators, the individual maximal code sequence generators can use a minimal number of feedback taps, thus reducing the complexity of the design. One advantage of Gold-codes is that it has been shown that cross-correlation between a set of codes is uniform and bounded (See R. C. Dixon, Spread-Spectrum Systems, John Wiley and Sons, New York, 1984, pp. 79–83). This advantage helps ensure that adjacent rows or columns will not have accidental correlation that could result in noticeable flicker to the user.

Figure 4A:
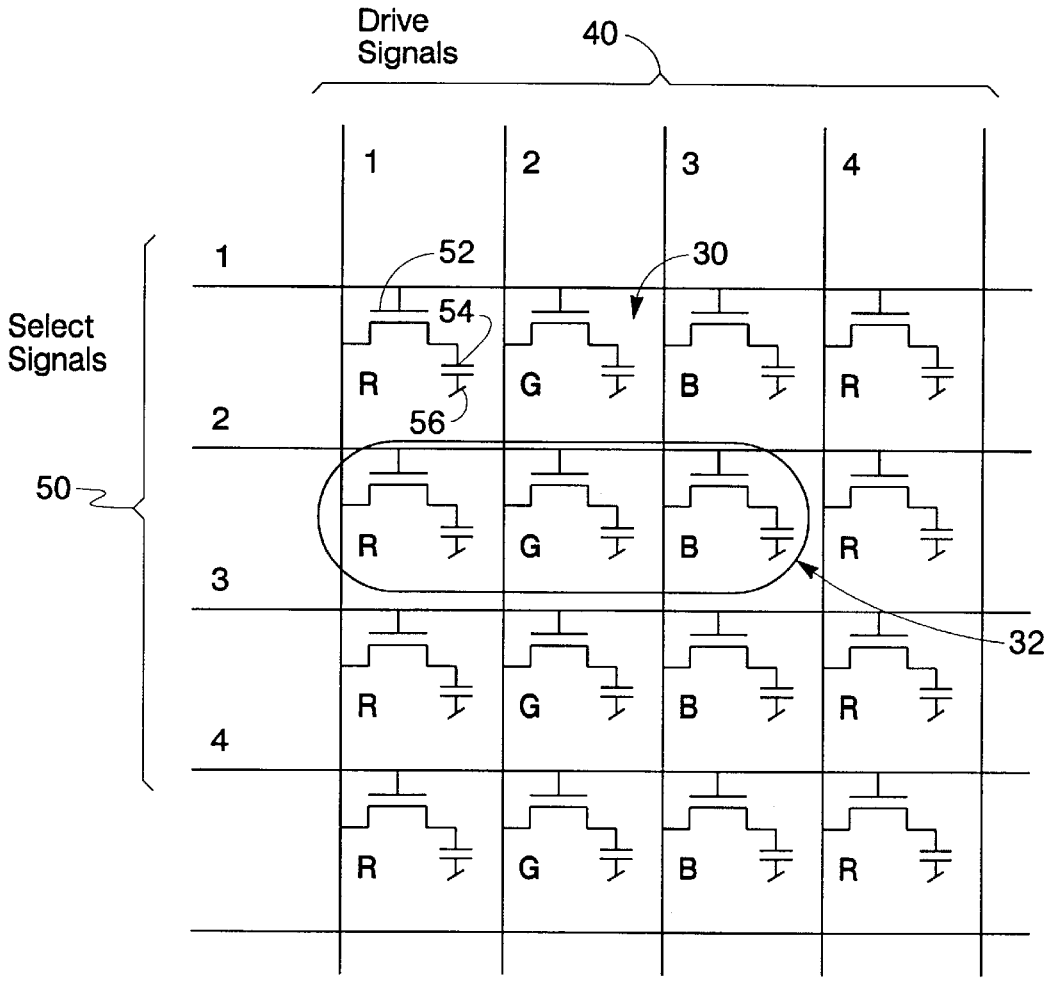
FIG. 4A is an illustration of an array of sub-pixels arranged in rows and columns using thin-film transistors as electronic elements.

FIG. 4A is a portion of a larger array of a color AM-LCD display using thin-film transistor technology for the electronic elements. The array is formed from a plurality of sub-pixels 30, which are arranged in sets of red, green, and blue pixels 32 to provide for full range of color. Each sub-pixel 30 has a cell 54 of liquid crystal material enclosed between two transparent electrodes. The array is driven by a set of drive signals 40 and a set of select signals 50. Each sub-pixel 30 has as its active electronic element a transistor 52 that has its gate connected to a select signal 50 and its source connected to a drive signal 40. The drain of transistor 52 is connected to one electrode of the sub-pixel cell 54. The other electrode of the sub-pixel cell 54 is connected to a common signal 56, typically ground, along with the other sub-pixel cells 54. Although thin-film transistor AM-LCD devices are popular, other active matrix elements exist which can be used to control the sub-pixel cell 54.

Figure 4B:
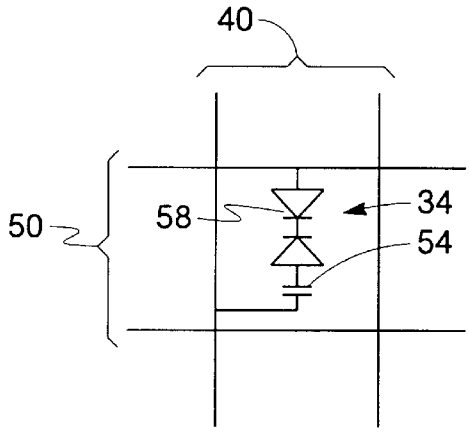
FIG. 4B is an illustration of a sub-pixel cell in which dual Zener diodes are used as an electronic element.

FIG. 4B is an illustration of a sub-pixel 34 that uses a dual diode structure 58 to form essentially a bidirectional Zener diode electronic element. One side of the dual diode structure 58 is connected to a select line 50. The other side of the dual diode structure 58 is connected to one electrode of the sub-pixel cell 54. The other electrode of the sub-pixel cell 54 is connected to a drive signal 40. Some implementations of this structure use a single Zener diode since the positive and negative drive levels can typically be chosen asymmetrically.

Figure 4C:
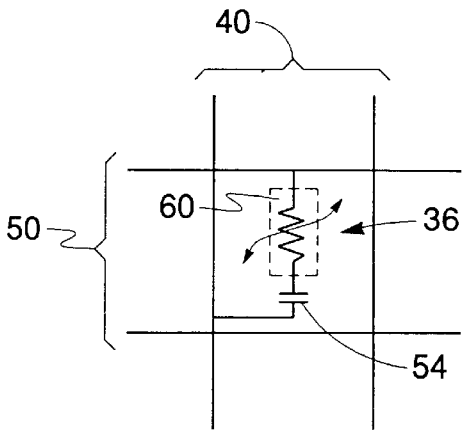
FIG. 4C is an illustration of a sub-pixel cell in which a metal-insulator-metal device is used as an electronic element.

FIG. 4C is an illustration of a sub-pixel 36 that uses a metal-insulator-metal technology device 60 as the electronic element used in the active matrix device. One side of the metal-insulator-metal technology device 60 is connected to a select line 50. The other side of the metal-insulator-metal technology device 60 is connected to one electrode of the sub-pixel cell 54. The other electrode of sub-pixel cell 54 is connected to a drive signal 40.

Figure 5:
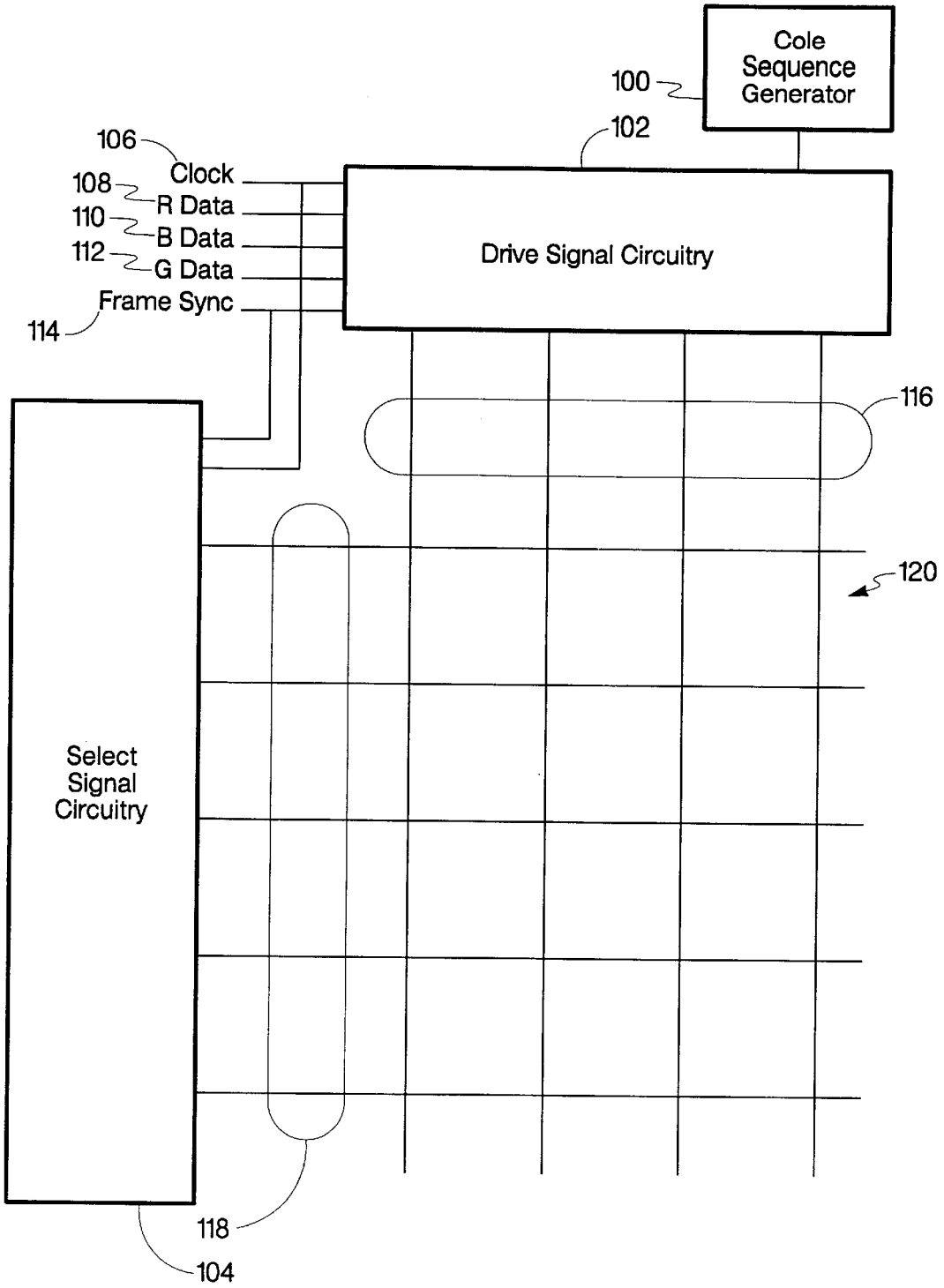
FIG. 5 is a block diagram of an exemplary embodiment of the invention.

FIG. 5 illustrates a portion of an active matrix array 120 having a set of drive signals 116 and a set of select signals 118. The drive signals 116 are connected to drive signal circuitry 102 that is further coupled to a Cole sequence generator 100. As previously defined, Cole sequence generator 100 is used to provide a random, semi-random or pseudo-random sequence pattern to inversion circuitry for each drive signal 116 contained within the drive signal circuitry 102. The select signals 118 are connected to select signal circuitry 104 which preferably sequentially selects one of the select signals so that one line in the active matrix array can be driven by drive signal circuitry 102. The image information to be presented on the AM-LCD device is presented on the R Data 108, B Data 110, and G Data 112 bus signal lines, which are clocked into the drive signal circuitry 102 with a clock 106. A frame sync 114 signal is connected to the drive signal circuitry 102 and the select signal circuitry 104 to allow the two sets of circuits to know when a frame of information begins. Other control signal lines such as line sync and data enable may be present and still meet the spirit and scope of the invention. The information presented on the data lines are converted to positive and negative drive levels which are selected by the Cole sequence from Cole sequence generator 100 to invert the data presented to each sub-pixel. The select signal circuitry 104 is preferably implemented using a counter which is reset on each frame sync signal and a de-multiplexer connected to the output of the counter to select one select signal 118 sequentially at a time. Although the select signals 118 do not have to be selected sequentially, it is preferable due to ease of implementation.

Figure 6:
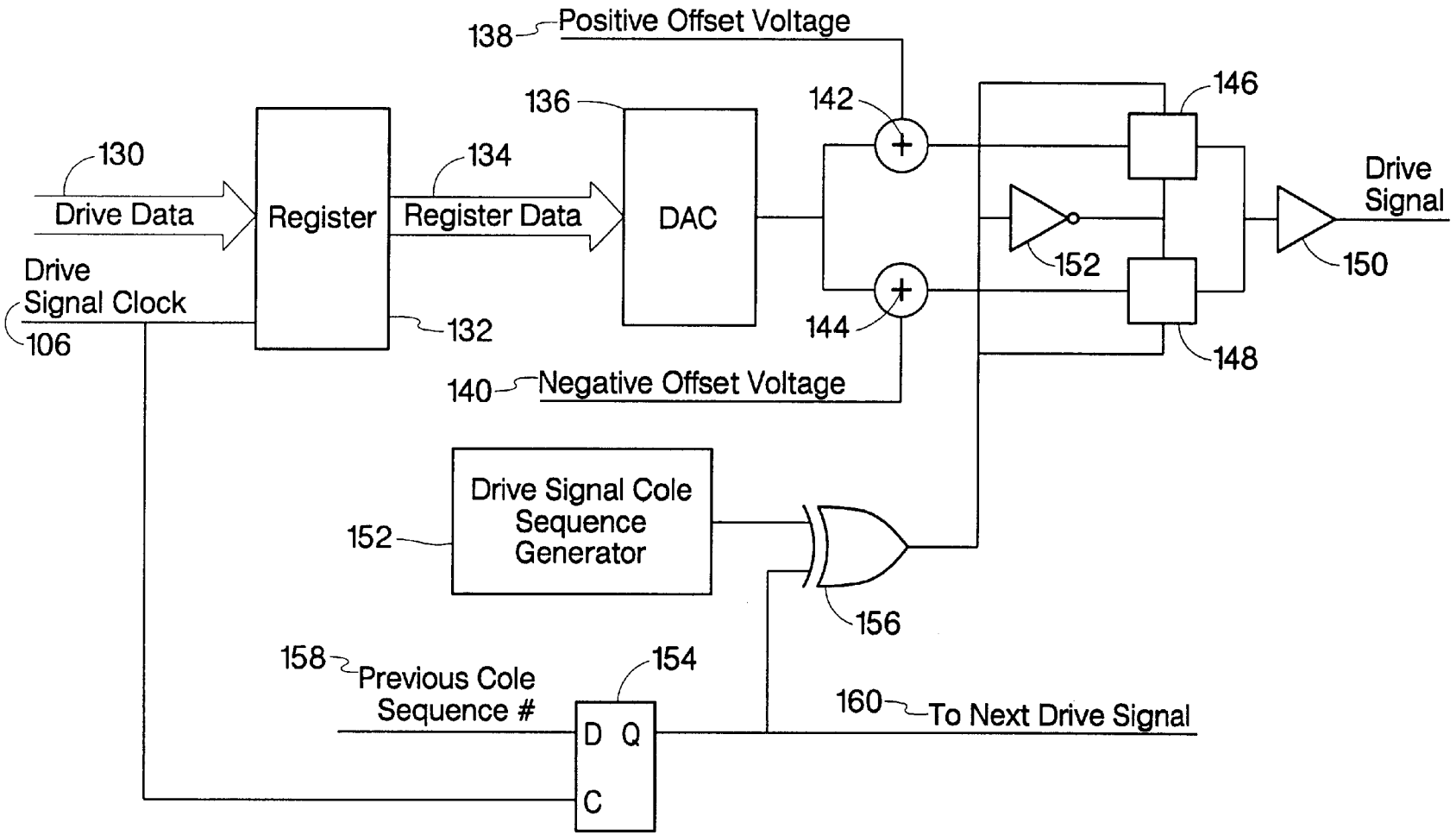
FIG. 6 is an exemplary block diagram of a column driver from the block diagram of FIG. 5.

FIG. 6 is an exemplary block diagram of circuitry used to control one drive signal. The information on drive data 130 (one of the R Data 108, B Data 110, or G Data 112 bus signals) is clocked by the clock 106 into a register 132. The output of the register 132 is represented as register data 134, which is connected to a digital to analog converter (DAC) 136. DAC 136 converts the digitally represented image data presented to it to an analog signal which is outputted and connected to a first analog adder 142 and a second analog adder 144. First analog adder 142 adds a positive offset voltage 138 to the DAC 136 output. Second analog adder 144 adds a negative offset voltage 140 to the DAC 136 output. The positive and negative offset voltages are predetermined for the type of AM-LCD device based on a number of criteria for image quality and AM-LCD device characteristics, such as the type of electronic element used for applying voltage to a sub-pixel cell. The output of the first analog adder 142 is connected to a first transmission gate 146. The output of the second analog adder 144 is connected to a second transmission gate 148. The outputs of first transmission gate 146 and second transmission gate 148 are coupled together and provide the input for drive buffer 150. Only one transmission gate is actively selected to drive the drive signal with either a positive signal or a negative signal. The selection of transmission gates is determined by a Cole sequence pattern.

The Cole sequence pattern is preferably produced by one drive signal Cole sequence generator 152 which is modulo-2 added (or more generally multiplied if using a base other than 2) in exclusive OR circuit 156 with a Cole sequence pattern phase shifted for each drive signal in register 154. The input to register 154 is the output of the previous drive signal's equivalent register 154. The output 160 of register 154 in connected to exclusive-OR 156 and is also used to provide the input to the next drive signal's input to its equivalent register 154. The first drive signal's register 154 input is driven by the Cole sequence generator 100 of FIG. 5. In this embodiment drive signal Cole sequence generator 152 is common to all drive signals. This arraignment of Cole sequence generators produces a Gold-code sequence for each drive signal using only two maximal code linear shift feedback registers. The Gold-code sequences have the desired cross-correlation and other properties mention above.

A first alternative embodiment is to have each drive signal have its own individual Cole sequence generator 152. This first alternative approach ensures that there is very low correlation between adjacent drive signals if the codes are chosen properly. A disadvantage over the preferred approach is that it requires more circuitry.

A second alternative embodiment is to eliminate Cole sequence generator 100 and the phase delay registers 154. Each drive signal has its own individual Cole sequence generator 152 to provide unique Cole sequences for each drive signal.

A third alternative embodiment is to have a single Cole sequence generator 100 which provides the input to the first phase-delay register 154 and additionally the drive signal Cole sequence generator 152 source. Thus, the Cole sequence generator 100 is modulo-2 added to a phase-delayed version of itself to produce a temporally unique Cole sequence for each drive signal. However, each temporally unique Cole sequence is a phase delayed version of the other signals and may produce some flicker with an image pattern that has similar delay elements. However, if the Cole sequence pattern is chosen so that the period r is not an integer or a fractional integer multiple of the number of select lines, then from frame to frame the phase shifted Cole sequence pattern will not remain in synchronization or align with a frozen image on the display and any flicker is substantially eliminated. This embodiment has the benefit of only requiring one single Cole sequence generator for the inversion circuitry.

Figure 7A:
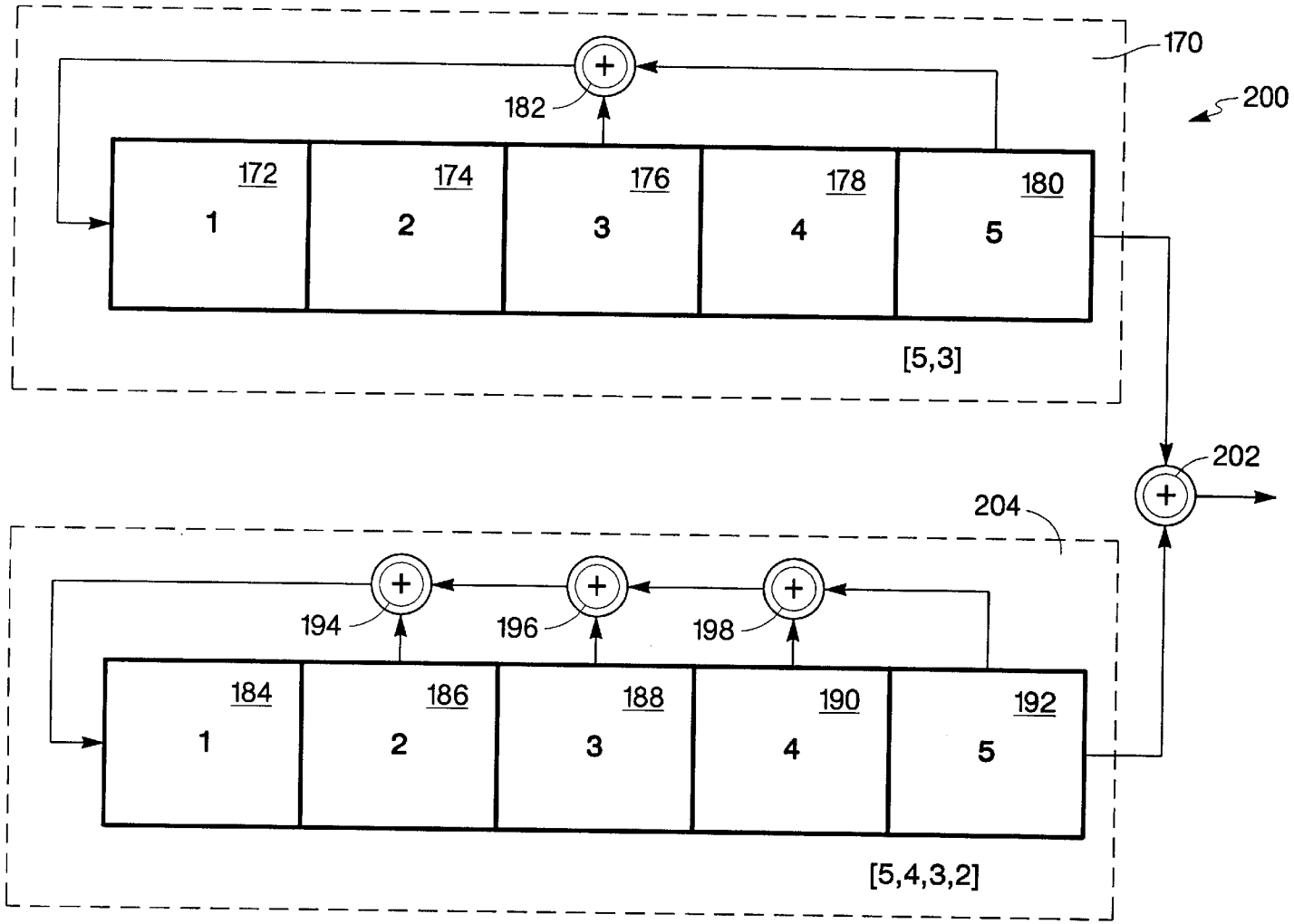
FIG. 7A is an exemplary block diagram of a pseudo-random code generator used in one embodiment of the invention.

FIG. 7A is an exemplary illustration of a Gold-code sequence generator 200 using two separate linear shift feedback registers that are modulo-2 added to form the resultant Gold-code sequence. First linear shift feedback register 170 is shown as five (n=5) shift registers 172, 174, 176, 178, and 180. The output of the third shift register 176 is modulo-2 added to the output of the fifth shift register 180 in a first modulo-2 adder 182. The output of the first modulo-2 adder 182 provides the input to the first shift register 172. This illustrates why there can not be a run of all zeros. If all of the five shift registers were set to zero, only zeros would be output from the fifth shift register 180 and a pseudo-random pattern would not result. Thus, the five shift registers are preferably preset to a one state during reset before clocking of the shift registers begin.

The second linear shift feedback register 204 is configured with five shift registers 184, 186, 188, 190 and 192. The outputs of the second, third, fourth and fifth shift registers are modulo-2 added in a second adder 194, a third adder 196, and a fourth adder 198 and the resultant value is inputted into the first shift resister 184. This arraignment produces a different sequence than the first linear shift feedback register 170, but both have the same sequence length of $r=2^5-1=31$ cycles. The outputs of the first linear shift feedback register 170 is modulo-2 added to the second linear shift feedback register 204 in fifth adder 202. The output of the fifth adder 202 is the desired Gold code sequence. Again, the five shift registers are preferably preset to a one during reset before being clocked to prevent an all-zero sequence from forming.

Figure 7B:
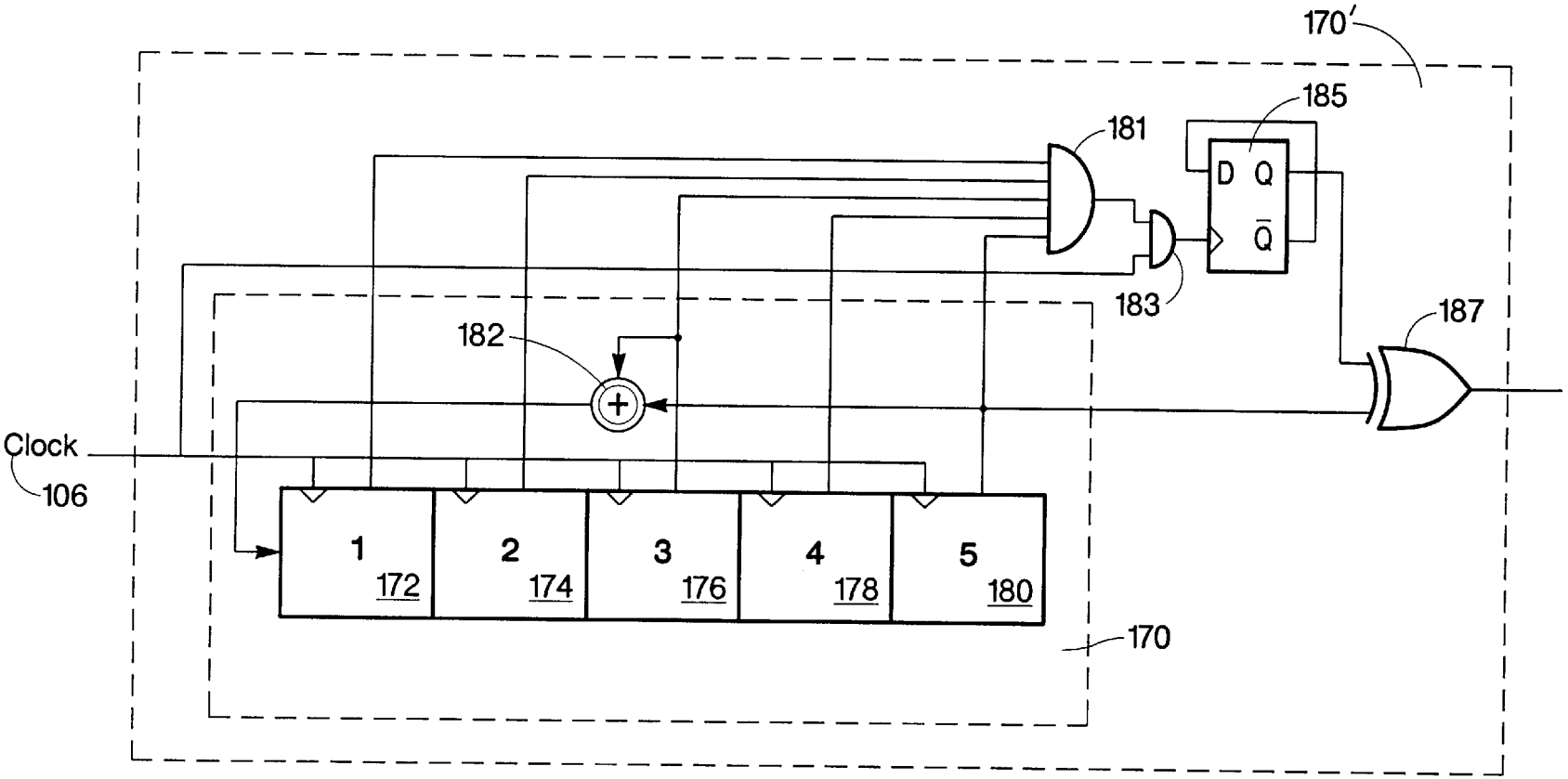
FIG. 7B is an exemplary block diagram of a circuit added to a pseudo-random code generator to remove an offset of 'one'.

FIG. 7B is an exemplary block diagram of an additional circuit which removes the residual offset of one 'one' that is inherent in maximal length pseudo-random sequence generators. First linear shift feedback register (LSFR) 170 is shown as having five shift registers 172, 174, 176, 178, and 180. The first LSFR 170 is configured to feed back the outputs of the third and fifth shift registers. Other feedback configurations are known to those skilled in the art (See Dixon, p. 87) and the use of these other feedback configurations would still meet the spirit and scope of the invention. As discussed previously, each maximal length pseudo-random sequence generator creates a single all 'ones' pattern during a maximal length sequence of code length r. This single all 'ones' pattern is used to alternatively invert or pass-through the output of the first LSFR 170. When the output is passed through, there will be a residual offset of one 'one'. When the output is inverted, there will be a residual offset of one 'zero'. Over the two maximal length sequences, the residual offsets will cancel, thus providing no direct-current bias voltage offset.

A new first LSFR 170' is formed using the additional circuit and first LSFR 170. The outputs of the five shift registers are connected to a first AND gate 181 to detect the all 'ones' state of the first LSFR 170. The output of the first AND gate 181 is used to gate the clock 106 with second AND gate 183. The output of the second AND gate 183 is used to clock a toggle flip-flop 185 that is configured to toggle its output state each clock cycle. The output of toggle flip-flop 187 is connected to an input of exclusive OR gate 187. Exclusive OR gate 187 has an additional input connected to the output of LSFR 170. The exclusive OR gate 187 provides the inversion or pass-through function depending on the state of the toggle flip-flop 185. The output of the exclusive OR gate 187 is the output of the new first LSFR 170'. This circuit can be applied to all other maximal code generators used in the drive circuitry to remove residual direct-current bias voltage.

Other methods of generating a Cole sequence signal for the drive circuitry have been envisioned that provide additional benefits over the use of maximal-code sequence generators.

Figure 8A:
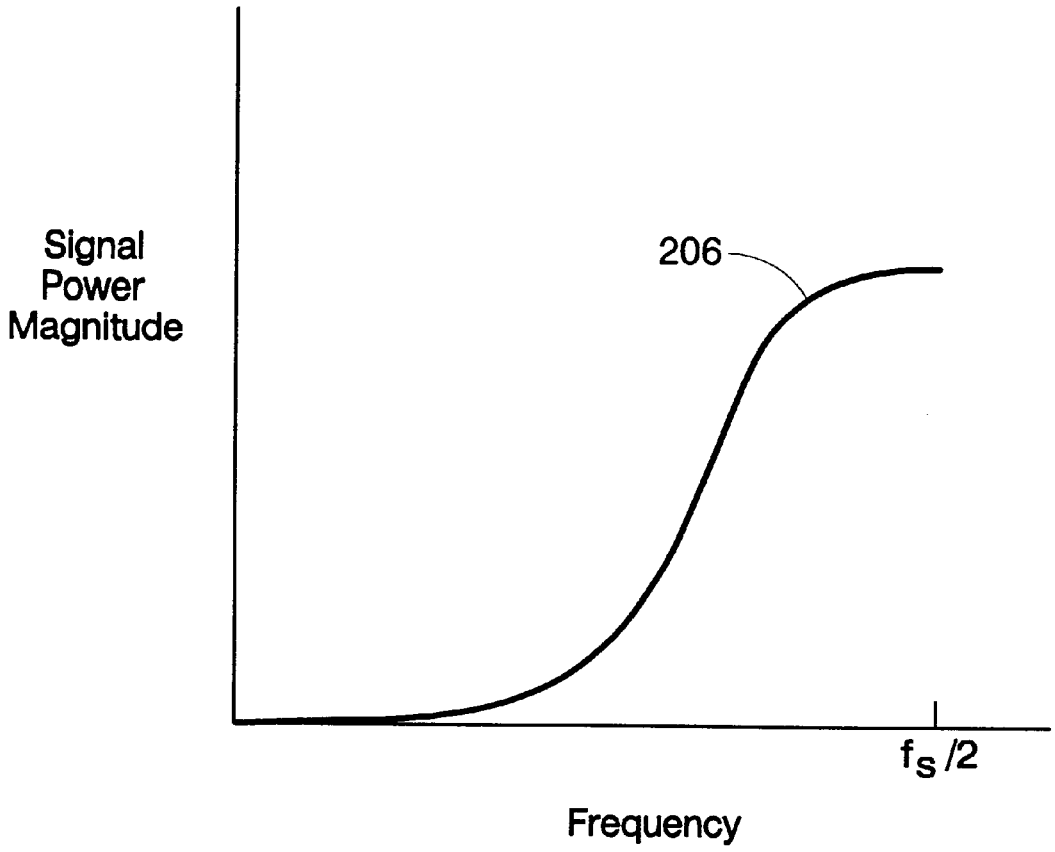
FIG. 8A is an illustration of the magnitude of the power spectrum of error noise generated in a delta-sigma modulator that has been noised-shaped to have higher frequency characteristics.

FIG. 8A is an illustration of the signal power magnitude verses frequency for a "noise-shaped" delta-sigma first order modulated error signal. When a signal is modulated with an oversampled delta-sigma modulated A/D converter, quantization error is introduced. Because the quantization error is fed-back to the input and subtracted from the next input, a differentiation of the error signal is performed that causes slowly changing errors (low frequency components) to be reduced or cancelled. The net effect is that the higher frequency components of the error signal are more likely to be introduced on the converted signal. Thus the delta-sigma signal power 208 has no DC component and is shaped toward high frequency components. This power spectrum shape means that a semi-random signal is rapidly changing in the time domain due to the high frequency components, thus it is improbable that long runs of 'ones' and 'zero' in the time domain will occur. Since a delta-sigma A/D modulator is generally designed to produce a digitized version of an analog input along with the noise-shaped quantization noise, the original input signal must be subtracted from the digitized output to retrieve just the error component. Further, since it is preferable that a binary version of the error signal be used to ease implementation, the retrieved error component is preferably converted to a binary sequence.

Figure 8B:
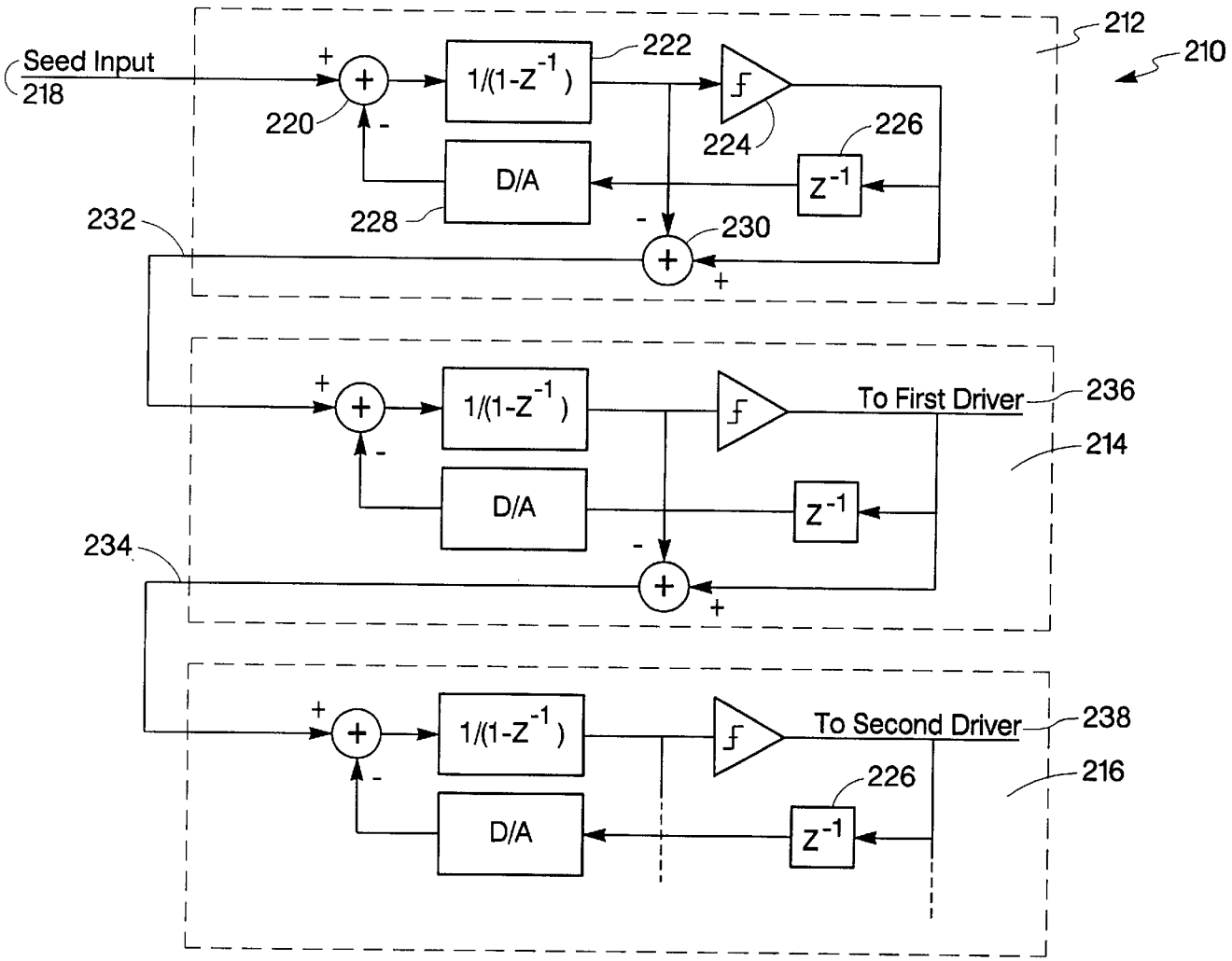
FIG. 8B is an exemplary embodiment of a delta-sigma modulated random code generator used in another embodiment of the invention.

FIG. 8B is an exemplary block diagram of a $1^{st}$ order delta-sigma modulated (DSM) noise generator 210 used in one embodiment of the invention. Higher order delta-sigma modulators could be substituted and still meet the spirit and scope of the invention. The DSM noise generator 210 has several delta-sigma modulator blocks. The first delta-sigma modulator block 212 is used to create the original noise-shaped quantization error signal. A seed input 218 is provided to a first adder block 220. Preferably, a dither signal (not shown) is added to the seed input to increase randomness. In first adder block 220, the previous output of the delta-sigma modulator is subtracted from the input. The output of the first adder block 220 is then inputted into an accumulator 222, shown as having a Z-transform of $1/(1-Z^{-1})$. Other accumulator Z transforms exist and are known to those skilled in the art and still meet the spirit and scope of the invention. Further, while the block diagram implies that the accumulator is constructed of digital circuitry, an analog-based accumulator can also be used and still meet the spirit and scope of the invention. The output of the accumulator 222 is then inputted to a comparator 224 that generates a digital signal along with adding in quantization error. Although preferably the comparator performs a binary operation, a multiple level comparator can be used and still meet the spirit and scope of the invention. The output of the comparator 224 is the digitized input signal and its noise-shaped quantization error. The output of the comparator 224 is then delayed by one clock cycle in delay element 226 to provide stability of the overall circuit. The delayed output of comparator 224 is then converted back to an analog signal in D/A 228 before being subtracted from the seed input in first adder block 220. Preferably D/A 228 is just a simple buffer for a binary signal but other D/A circuits still would meet the spirit and scope of the invention. To recover a first noise-shaped error signal 232, the output of accumulator 222 is subtracted from the output of comparator 224. Since this first noise-shaped error signal 232 is a multi-level signal, it is then feed into a second DSM 214 to create a first binary output 232 used for the first driver signal. When the first binary output 232 is created, a new quantization noise source is created in the comparator of DSM 214. This new quantization noise can be recovered similar to that in second adder 230 to create a second noise-shaped error signal 234 which is converted to a binary signal in a third DSM 216 to be used by a second driver circuit. In one embodiment it is envisioned that each drive signal inversion circuitry has a DSM which uses the quantization noise generated from the previous drive signal DSM as its seed input. This alternative embodiment provides each drive signal in an active matrix device with a unique Cole sequence.

Figure 9A:
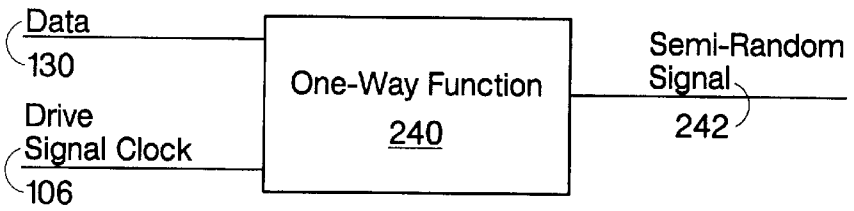
FIG. 9 is an exemplary embodiment of a one-way function based on a Cole sequence generator used in another embodiment of the invention.

FIG. 9A illustrates another method of generating a Cole sequence. This method performs a one-way function 240 on the drive data stream 130 to the active matrix drive circuitry, clocked by the drive signal clock 106, to generate a semi-random signal 242 binary stream. A one-way function is a function that easily performs a result in one direction yet it is difficult to invert or recover the original data stream with only the result of the one-way function. Several one-way functions that are fairly easy to implement are checksums, cyclic redundancy checks, and signature analysis. Other one way functions exist and are known to those skilled in the art and their use would still meet the spirit and scope of the invention. The output of the one way function is then used for either the Cole sequence signal generator 100 of FIG. 5 or the drive signal Cole sequence number generator 152 in FIG. 6 or both.

Figure 9B:
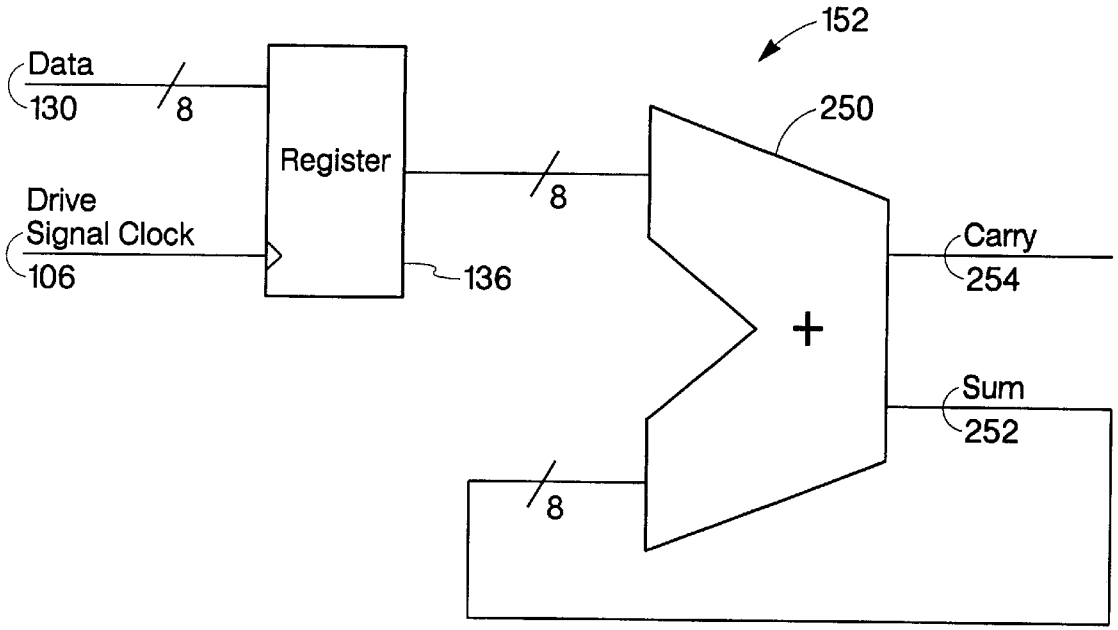

FIG. 9B is an exemplary embodiment of a one-way function using a modulo 8 checksum with carry to create a Cole sequence generator 152 in FIG. 6. The output of register 132 is inputted into a first input of an adder circuit 250 which produces a sum output 252 and a carry output 254. The sum output 252 is fed back to a second input of the adder circuit 250. If an overflow occurs, the carry output 254 is set to a one. If no overflow occurs, then the carry output is set to a zero. Since the adder is a continual modulo addition of past image data streams, the carry output is not directly correlated to the present data to be displayed on the AM-LCD. Thus, the image and inversion patterns will have low cross correlation. The carry output 254 will not typically have long strings of 'ones' and 'zero' with ordinary display patterns. The carry output 254 becomes the drive signal Cole sequence number generator 152 output.

By selecting the polarity of the display data with a Cole sequence to provide inversion, an AM-LCD device has reduced flicker, particularly for static images, while simultaneously still reducing direct-current bias voltages on the sub-pixels. Several different embodiments for implementing the Cole sequence generator have been described and illustrated using maximal code, Gold-codes, delta-sigma generated, and one-way function sequences. Several other random-sequence generators that can produce Cole sequences are known to those skilled in the art and their use would still meet the spirit and scope of the invention. The invention is only limited by the claims.

What is claimed is:

1. An active matrix device, comprising:

a plurality of drive signals;

a plurality of select signals;

an array of sub-pixels, each sub-pixel having an electronic element connected to one of said plurality of drive signals and one of said plurality of select signals for displaying an image; and inversion circuitry for reducing flicker of said active matrix device below a minimum human perception level and having at least one Cole sequence generator capable of generating a Cole sequence, the inversion circuitry coupled to said plurality of drive signals wherein said inversion circuitry is capable of reducing direct current bias voltage applied by said electronic element to said sub-pixel, and wherein the image and the Cole sequence are substantially uncorrelated.

2. The active matrix device of claim 1 wherein the minimum human perception level is defined such that the flicker has component frequencies and the component frequencies below 60 Hz are substantially reduced.

3. The active matrix device of claim 1 wherein the correlation between the image and the Cole sequence has a power spectral density where only frequencies greater than 60 Hz have substantial energy.

4. The active matrix device of claim 1, wherein said electronic element is a thin-film transistor having a gate, a source, and a drain wherein said gate is connected to one of said plurality of select signals, said source is connected to one of said plurality of drive signals, and said drain is connected to a respective sub-pixel.

5. The active matrix device of claim 1, wherein said electronic element has at least one Zener diode.

6. The active matrix device of claim 1, wherein said electronic element is a metal insulator metal technology device.

7. The active matrix device of claim 1, wherein said at least one Cole sequence generator in said inversion circuitry further comprises a plurality of Cole sequence generators individually coupled to one of said plurality of drive signals.

8. The active matrix device of claim 1, wherein said inversion circuitry generates a Cole sequence using maximal length sequences for each one of said plurality of drive signals.

9. The active matrix device of claim 8, wherein said maximal length sequence has an inherent residual offset of DC bias voltage and wherein said inversion circuitry further comprises circuitry to cancel said residual offset of DC bias voltage.

10. The active matrix device of claim 1, wherein said drive circuitry is coupled to an input data stream of the image and wherein said at least one Cole sequence generator in said inversion circuitry generates a Cole sequence using a one-way function applied to said input data stream.

11. An electronic device comprising the active matrix device of claim 1.

12. An active matrix device, comprising:

a plurality of drive signals;

a plurality of select signals;

an array of sub-pixels, each sub-pixel having an electronic element connected to one of said plurality of drive signals and one of said plurality of select signals for displaying an image; and inversion circuitry for reducing flicker of said active matrix device below a minimum human perception level having at least one Cole sequence generator capable of generating a Cole sequence, the inversion circuitry coupled to said plurality of drive signals wherein said inversion circuitry is capable of reducing direct current bias voltage applied by said electronic element to said sub-pixel, and wherein the image and Cole sequence are substantially statistically independent.

13. An active matrix device, comprising:

a plurality of drive signals;

a plurality of select signals;

an array of sub-pixels, each sub-pixel having an electronic element connected to one of said plurality of drive signals and one of said plurality of select signals for displaying an image; and inversion circuitry for reducing flicker of said active matrix device below a minimum human perception level having at least one Cole sequence generator capable of generating a Cole sequence, the inversion circuitry coupled to said plurality of drive signals wherein said inversion circuitry is capable of reducing direct current bias voltage applied by said electronic element to said sub-pixel, wherein the Cole sequence is comprised of successive bits and wherein each successive bit is substantially statistically independent of other successive bits.

14. An active matrix device, comprising:

a plurality of drive signals;

a plurality of select signals;

an array of sub-pixels, each sub-pixel having an electronic element connected to one of said plurality of drive signals and one of said plurality of select signals for displaying an image; and inversion circuitry having at least one Cole sequence generator capable of generating a Cole sequence, the inversion circuitry coupled to said plurality of drive signals wherein said inversion circuitry is capable of reducing direct current bias voltage applied by said electronic element to said sub-pixel, wherein said at least one Cole sequence generator in said inversion circuitry generates a Cole sequence using Gold-code sequences for each one of said plurality of drive signals.

15. An active matrix device, comprising:

a plurality of drive signals;

a plurality of select signals;

an array of sub-pixels, each sub-pixel having an electronic element connected to one of said plurality of drive signals and one of said plurality of select signals for displaying an image; and inversion circuitry having at least one Cole sequence generator capable of generating a Cole sequence, the inversion circuitry coupled to said plurality of drive signals wherein said inversion circuitry is capable of reducing direct current bias voltage applied by said electronic element to said sub-pixel and wherein said at least one Cole sequence generator in said inversion circuitry generates a Cole sequence using error derived from a delta-sigma modulated signal.

16. A method for inverting an active matrix display having a plurality of drive signals, a plurality of select signals, and an array of sub-pixels wherein each sub-pixel of said array of sub-pixels is connected to one of said plurality of drive signals and one of said plurality of select signals, the method comprising the steps of:

sequentially activating each select signal from said plurality of select signals to address individual subsets of said array of sub-pixels;

activating said plurality of drive signals in succession with said sequentially activating of each select signal wherein each of said plurality of drive signals is activated with a positive drive level and a negative drive level;

generating a Cole sequence; and selecting between said positive level and said negative level with said Cole sequence for each of the activated plurality of drive signals wherein during said step of sequentially activating direct current bias voltage is reduced and wherein the Cole sequence is chosen such that undesired optical artifacts are substantially prevented over time from forming within each pixel.

17. The method of claim 16 wherein observable flicker from the active matrix device is substantially reduced.

18. The method of claim 17 wherein the step of selecting further comprises reducing component frequencies of the flicker below 60 Hz to unobservable levels.

19. The method of claim 16 wherein the step of generating said Cole sequence further comprises the step of generating said Cole sequence using at least one maximal length sequence generator.

20. The method of claim 19 wherein the at least one maximal length sequence generator creates a residual offset direct current bias voltage and wherein the step of generating said Cole sequence further comprises the step of canceling said residual offset direct current bias voltage.

21. The method of claim 16, further comprising the step of:

clocking an image data stream into said active matrix device; and wherein the step of generating said Cole sequence further comprises the step of applying a one-way function on said image data stream.

22. The method of claim 16 wherein the step of generating said Cole sequence further comprises the step of generating a unique Cole sequence for each of said plurality of drive signals.

23. The method of claim 22, wherein the step of generating said Cole sequence further comprises the steps of:

generating an additional common Cole sequence; and multiplying each unique Cole sequence with said additional common Cole sequence.

24. The method of claim 16 wherein the step of generating a Cole sequence further comprises the step of time-shifting a single Cole sequence for each of said plurality of drive signals.

25. The method of claim 16, further comprising the step of:

clocking an image data stream into said active matrix device; and wherein the step of generating said Cole sequence further comprises the step of creating said Cole sequence such that the image data stream and the Cole sequence are substantially statistically independent.

26. The method of claim 16, further comprising the step of:

clocking an image data stream into said active matrix device; and wherein the step of generating said Cole sequence further comprises the step of creating said Cole sequence such that the image data stream and the Cole sequence are substantially uncorrelated.

27. A method for inverting an active matrix display having a plurality of drive signals, a plurality of select signals, and an array of sub-pixels wherein each sub-pixel of said array of sub-pixels is connected to one of said plurality of drive signals and one of said plurality of select signals, the method comprising the steps of:

sequentially activating each select signal from said plurality of select signals to address individual subsets of said array of sub-pixels;

activating said plurality of drive signals in succession with said sequentially activating of each select signal wherein each of said plurality of drive signals is activated with a positive drive level and a negative drive level;

generating a Cole sequence; and selecting between said positive level and said negative level with said Cole sequence for each of the activated plurality of drive signals wherein during said step of sequentially activating direct current bias voltage is reduced and wherein the step of generating a Cole sequence further comprises creating a series of successive bits and wherein each successive bit is substantially statistically independent from the other successive bits.

28. A method for inverting an active matrix display having a plurality of drive signals, a plurality of select signals, and an array of sub-pixels wherein each sub-pixel of said array of sub-pixels is connected to one of said plurality of drive signals and one of said plurality of select signals, the method comprising the steps of:

sequentially activating each select signal from said plurality of select signals to address individual subsets of said array of sub-pixels;

activating said plurality of drive signals in succession with said sequentially activating of each select signal wherein each of said plurality of drive signals is activated with a positive drive level and a negative drive level;

generating a Cole sequence; and selecting between said positive level and said negative level with said Cole sequence for each of the activated plurality of drive signals wherein during said step of sequentially activating direct current bias voltage is reduced and wherein the step of generating said Cole sequence further comprises the step of generating said Cole sequence using at least one Gold-code sequence generator.

29. A method for inverting an active matrix display having a plurality of drive signals, a plurality of select signals, and an array of sub-pixels wherein each sub-pixel of said array of sub-pixels is connected to one of said plurality of drive signals and one of said plurality of select signals, the method comprising the steps of:

sequentially activating each select signal from said plurality of select signals to address individual subsets of said array of sub-pixels;

activating said plurality of drive signals in succession with said sequentially activating of each select signal wherein each of said plurality of drive signals is activated with a positive drive level and a negative drive level;

generating a Cole sequence; and selecting between said positive level and said negative level with said Cole sequence for each of the activated plurality of drive signals wherein during said step of sequentially activating direct current bias voltage is reduced and wherein the step of generating said Cole sequence further comprises the step of generating said Cole sequence using a delta-sigma modulator error signal created from a delta-sigma modulated signal.

* * * * *